United States Patent [19]

Asano et al.

[11] Patent Number: 4,696,627

[45] Date of Patent: Sep. 29, 1987

[54] SCROLL COMPRESSOR

[75] Inventors: Hideo Asano, Gifu; Kazuhisa Makida; Kenichi Fujiwara, both of Kariya, all of Japan

[73] Assignee: Nippondenso Co., Ltd., Kariya, Japan

[21] Appl. No.: 897,021

[22] Filed: Aug. 15, 1986

[30] Foreign Application Priority Data

Aug. 15, 1985 [JP] Japan ..... 60-178641
Aug. 15, 1985 [JP] Japan ..... 60-178642

[51] Int. Cl.[4] ..... F01C 1/02
[52] U.S. Cl. ..... 418/15; 418/55
[58] Field of Search ..... 418/55, 15; 62/199, 62/200

[56] References Cited

U.S. PATENT DOCUMENTS

| | | | |
|---|---|---|---|
| 4,216,661 | 8/1980 | Tojo et al. | 418/55 X |
| 4,382,754 | 5/1983 | Shaffer et al. | 418/55 |
| 4,431,388 | 2/1984 | Eber et al. | 418/55 |
| 4,470,778 | 7/1984 | Mabe | 418/55 |
| 4,496,296 | 1/1985 | Arai et al. | 418/55 |
| 4,565,072 | 1/1986 | Fujiwara et al. | 62/196.2 |

FOREIGN PATENT DOCUMENTS

| | | | |
|---|---|---|---|
| 168561 | 1/1986 | European Pat. Off. | 418/55 |
| 57-76290 | 5/1982 | Japan . | |

*Primary Examiner*—William E. Tapolcai
*Attorney, Agent, or Firm*—Cushman, Darby & Cushman

[57] ABSTRACT

A scroll compressor comprises a housing including therein a suction chamber, a stationary scroll member including an end plate and a scroll element and being fixedly disposed within the housing, a movable scroll member including an end plate and a scroll element and being movably disposed within the housing to be capable of revolving around a center axis of the stationary scroll member but being prevented from rotating around its own axis, a plurality of working chambers each of which is defined by both scroll elements and moves centripetally and circumferentially while decreasing a volume thereof upon revolution of the movable scroll member, a stationary partition extending from an inner wall surface of the housing to the scroll element of the stationary scroll member, a movable partition radially reciprocatingly projecting from the inner wall surface of the housing and abutting against the scroll element of the movable scroll member, two suction chamber sections into which the suction chamber is divided by both scroll members and both partitions, and two inlet ports opening to the respective suction chamber sections and introducing the respective fluids into the suction chamber sections therethrough, which have different pressure levels.

8 Claims, 18 Drawing Figures

$\theta = 0°$
$\theta = 360°$ $\theta = 90°$ $\theta = 270°$ $\theta = 180°$

SCROLL COMPRESSOR

FIELD OF THE INVENTION AND RELATED ART STATEMENT

The present invention relates to a scroll type compressor, and more particularly to a scroll compressor for use in a cooling/refrigerating system or a freezing-/refrigerating system, in which two fluid flows having different pressure levels are returned back to the compressor.

In a conventional cooling/refrigerating system in which a refrigerant is recirculated for a cooling evaporator and a refrigerating evaporator by a single refrigerant compressor, a swash plate compressor having a plurality (say, ten) of cylinders has been used therefor. In this case, nine of ten cylinders constitute a main compressor portion having a main suction port connected to the cooling evaporator, and the remaining single cylinder constitutes a sub-compressor portion having a subsuction port connected to an outlet of the refrigerating evaporator. The cylinder of the sub-compressor portion is made to communicate with the main suction port, upon a final stage of the suction stroke, by means of a communicating means. The refrigerant for cooling having a higher pressure is introduced into the sub-compressor portion by a pressure difference between the refrigerant for cooling and the lower pressure refrigerant derived from the refrigerating evaporator, so that the compression stroke of the sub-compressor portion is commenced at a pressure level which is equal to that of the higher pressure of the cooling refrigerant. Thus, obviated is a problem that an outlet flow rate of the refrigerant in the sub-compressor portion would be insufficient.

Also, in the case where a vane type compressor is used instead of the above-described compressor, the main and sub-suction ports are made to communicate, in order, with the interior of the compressor so that the refrigerant derived from the cooling evaporator is sucked thereinto after the refrigerant derived from the refrigerating evaporator has been sucked thereinto at an initial stage of the suction stroke.

Also, Japanese Patent Unexamined Publication No. 76290/82 shows a scroll compressor in which a closed space between a stationary scroll member and a movable scroll member is moved circumferentially and centripetally while reducing its volume, thereby performing a fluid compression.

In general, a scroll type compressor enjoys the following advantages: (a) the small number of necessary mechanical parts; (b) a high compression efficiency; and (c) a small torque change during the operation and hence, low vibrations and low noises. However, as is well known to those skilled in the art, the conventional scroll type compressor cannot be used as a compressor for suction and compression of fluids that have two or more different pressure levels as in the cooling/refrigerating systems. This is because, in the compressor of this type, when a space between an inner surface of an outer end portion of a scroll element of the stationary scroll member and an outer peripheral surface of a scroll element of a movable scroll member, and a space between an inner surface of an outer end portion of a scroll element of the movable scroll member and an outer peripheral surface of the scroll element of the stationary scroll member are opened, respectively, in fluid communication with a single suction chamber within a compressor housing by the revolving or swivelling motion of the movable scroll member, the fluids are introduced into the above-described spaces from the suction chamber, thereby performing the entrainment, i.e., suction of the fluids.

SUMMARY OF THE INVENTION

In view of the above-noted defects inherent in the prior art, an object of the present invention is to provide a scroll type compressor which is capable of sucking and compressing fluids from two or more fluid circuits having different pressure levels.

According to the present invention, there is provided a scroll compressor comprising: a housing including therein a suction chamber; a stationary scroll member fixedly disposed within the housing, the stationary scroll member including a first end plate and a first scroll element projecting from one surface of the first end plate; a movable scroll member movably disposed within the housing, the movable scroll member including a second end plate and a second scroll element projecting from one surface of the second end plate opposite the one surface of the first end plate; means for driving the movable scroll member to make it revolve around a center axis of the stationary scroll member but preventing the movable scroll member from revolving around its own axis; a plurality of working chambers each defined by the first scroll element and the second scroll element which is angularly offset from and engaged with the first scroll element, a radially outermost working chamber opening to the suction chamber to introduce fluid to be pressurized from the suction chamber, and each of the working chambers moving circumferentially, radially inwardly in order while decreasing a volume thereof upon revolution of the movable scroll member; outlet port means for discharging the pressured fluid from the working chamber, the outlet port means including an outlet port; a stationary partition extending from an inner wall surface of the housing to a radially outermost surface of the first scroll element of the stationary scroll member; a movable partition radially reciprocatingly projecting from the inner surface of the housing and abutting against a radially outermost surface of the second scroll element of the movable scroll member, the suction chamber being divided into two suction chamber sections by both the scroll members and both the partitions; first inlet port means having a first inlet port for introducing fluid to be pressurized, having a first pressure level, into one of the suction chamber sections, the first inlet port opening to one of the suction chamber sections; and second inlet port means having a second inlet port for introducing fluid to be pressurized, having a second pressure level different from the first pressure level, into the other suction chamber section, the second inlet port opening to the last-mentioned suction chamber section.

According to another aspect of the invention, there is provided a scroll type compressor further comprising sub-suction port means having a sub-suction port for introducing fluid to be pressurized having a third pressure level that is higher than the first pressure level, wherein, at an initial stage of a compression cycle of the fluid having the first pressure level, the sub-suction port means is caused to communicate with the working chamber into which introduced is the fluid having the first pressure level.

This and other objects, features and advantages of the present invention will become more apparent from the following description taken in conjunction with the accompanying drawings.

DETAILED DESCRIPTION OF PREFERRED EMBODIMENTS

Figure 3:
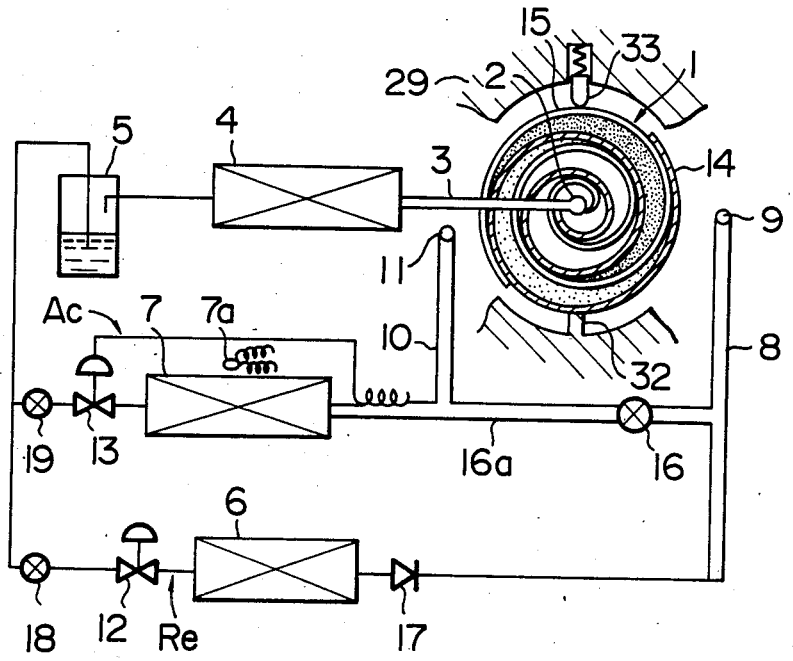
FIG. 3 is a view showing a piping system of a cooling/refrigerating system to which the compressor shown in FIG. 1 is applied.

The present invention will now be described with reference to the accompanying drawings. FIG. 3 which shows an automotive cooling/refrigerating system including a scroll type compressor 1 to which the present invention is applied. In FIG. 3, the compressor 1 is driven through an electromagnetic clutch by an automotive engine. An outlet port 2 located centrally in the compressor is in fluid communication with an inlet of a condenser 4 through a discharge valve (not shown) and a high pressure pipe 3. An outlet of the condenser 4 is connected to an inlet of a receiver 5. A refrigerant circuit Ac for air-conditioning and a refrigerant circuit Re for refrigerating are connected to a liquid refrigerant outlet of the receiver 5 in parallel relation with each other. The refrigerant circuit Re has a refrigerating evaporator 6 on an upstream side of which disposed is an expansion device composed of a constant pressure expansion valve 12 having a valve opening gauge pressure set at, for example, 0.5 kg/cm$^2$, and on a downstream side of which disposed is a check valve 17. The check valve 17 is connected at its downstream side to a first suction port 9 of the compressor 1 through a low pressure pipe 8.

The refrigerant circuit Ac has a cooling evaporator 7 on an upstream side of which disposed is an expansion device composed of a temperature sensing type expansion valve 13 for regulating a flow rate of refrigerant so as to control a super heating degree thereof at an outlet of the evaporator 7 to a predetermined level. The outlet of the cooling evaporator 7 is connected to a second inlet port 11 of the compressor 1 through a low pressure pipe 10. Disposed on an air outlet side of the cooling evaporator 7 is a temperature sensor 7*a* composed of a thermistor. When a temperature detected by the temperature sensor 7*a* is less than a predetermined temperature (for example, 3° C.), a power supply to the electromagnetic clutch 20 (shown in FIG. 2) of the compressor 1 is interrupted by a control circuit (not shown), thus stopping the operation of the compressor 1. Thus, the evaporation pressure in the cooling evaporator 7 is prevented from lowering less than a gauge pressure of 2.5 kg/cm$^2$, thereby preventing the cooling evaporator from frosting. The low pressure pipes 8 and 10 are connected to each other through a connecting pipe 16*a* having an electromagnetic valve 16 in its mid-portion. When the electromagnetic valve 16 is opened, the refrigerant for air-conditioning from the cooling evaporator 7 is introduced from the low pressure pipe 10 through the connecting pipe 16*a* into the low pressure pipe 8, and is sucked into the compressor 1 through the first suction port 9. When the electromagnetic valve 16 is closed, the refrigerant is separately sucked into the compressor 1 through the first suction port 9 and the second suction port 11, respectively, independently of each other.

The refrigerant circuits Re and Ac have electromagnetic valves 18 and 19 just at their upstream sides, respectively. The electromagnetic valves 18 and 19 selectively occupy opened or closed positions, respectively.

Figure 4:
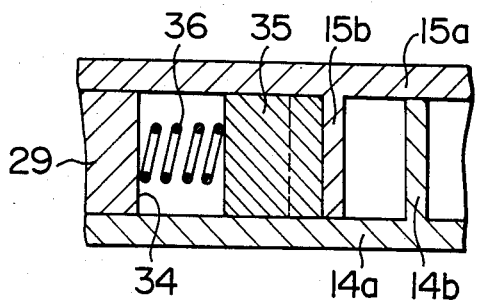
FIG. 4 is a fragmentary cross-sectional, enlarged view taken along the line IV—IV of FIG. 1.

A structure of the scroll type compressor 1 will now be described hereinunder with reference to FIGS. 1, 2 and 4.

The compressor 1 has a cup-shaped housing 29 whose open end is closed by a front end plate 28. The first and second suction ports 9 and 11 are formed in diametrically opposite to each other in a peripheral wall of the housing 29. The outlet port 2 is formed in an inclined wall of the housing 29. A stationary scroll member 14 and a movable scroll member 15 are housed in the housing 29. The stationary scroll member 14 includes a first end plate 14*a* fixedly secured to the housing 29 and a first scroll element 14*b* projecting from one surface of the end plate 14*a*. The movable scroll member 15 includes a second end plate 15*a* confronted with the stationary scroll member 14 and a second scroll element 15*a* projecting from the second end plate 15*a*, which engages with the first scroll element 14*b* in an angularly offset manner to define therebetween substantially crescent-shaped working chambers 30 and 31.

The housing 29 is provided with a suction chamber 24. Formed between an end wall of the housing 29 and the first end plate 14*a* is a discharge chamber 27 which normally communicates with the outlet port 2. An outlet port 27*a* is formed in a central portion of the first end plate 14*a*. The outlet port 27*a* normally communicates with the outlet chamber 27 through a discharge valve 40 which opens at a predetermined pressure level.

Figure 1:
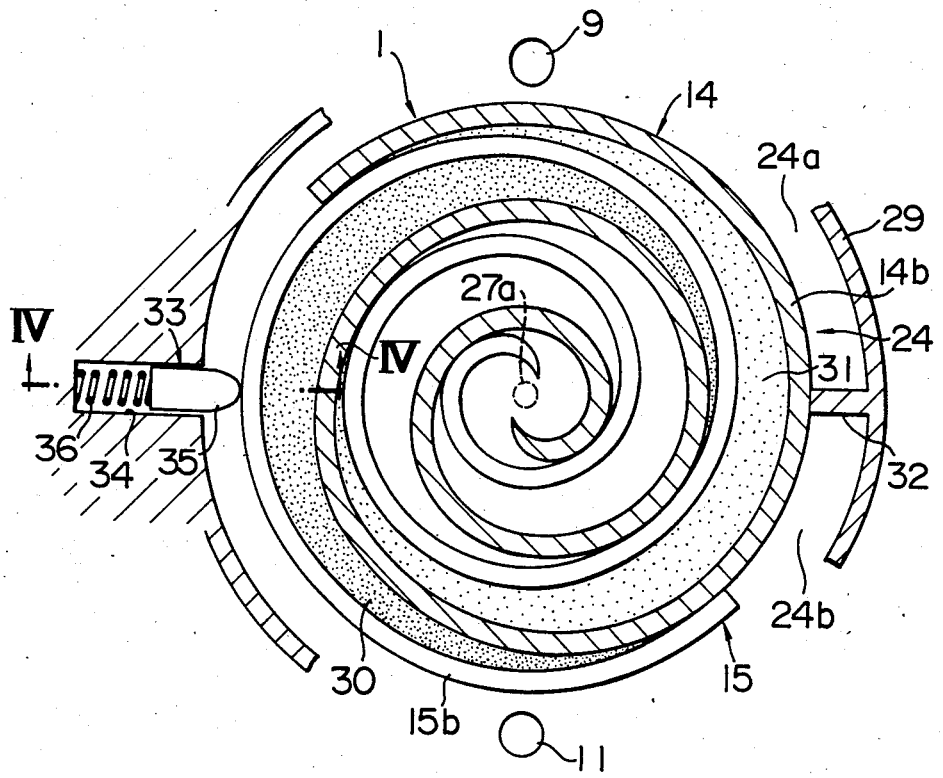
FIG. 1 is a fragmentary cross-sectional view taken along the line I—I of FIG. 2, showing a scroll compressor in accordance with one embodiment of the invention.

As clearly shown in FIG. 1, a stationary partition 32 extends radially inwardly from an inner peripheral wall of the housing 29 to the scroll element 14*b* of the stationary scroll 14, and a gap between the partition 32 and the scroll element 14*b* is completely sealed by a suitable seal member (not shown). On the diametrically opposite side with respect to the outlet port 27a, there is provided a movable partition 33 that extends from the inner peripheral wall of the housing 29 and abuts on an outermost surface of the scroll element 15b of the movable scroll member 15. The movable partition 33 includes a partition member 35 one end portion of which is received slidably and fluid-tightly in a recess 34 formed in the peripheral wall of the housing 29, and a spring 36 interposed between a bottom of the recess 34 and one end of the movable partition member 35 (see FIG. 4). Even if the movable scroll member 15 is revolved or swivelled, the spring force of the spring 36 causes the partition member 35 to be normally held in contact at the other end thereof with the outermost peripheral surface of the scroll element 15b of the movable scroll member 15. The suction chamber 24 is divided into a first suction chamber section 24a and a second suction chamber section 24b by the scroll members 14 and 15 and the partitions 32 and 33. The first suction port 9 is always made to communicate with the first suction chamber section 24a and the second suction port 11 is always made to communicate with the second suction chamber section 24b.

Figure 2:
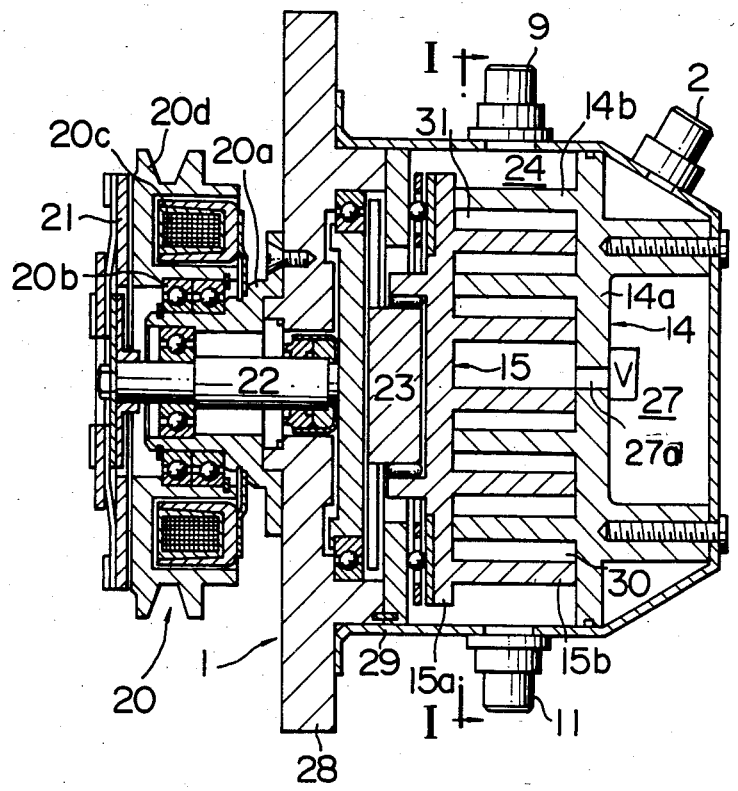
FIG. 2 is a longitudinal cross-sectional view of the compressor shown in FIG. 1.

As shown in FIG. 2, a belt driven pulley 20d of the electromagnetic clutch 20 is mounted rotatably through a bearing 20b on a hollow support axle 20a fixed to an outer end face of the front end plate 28. A clutch plate 21 of the electromagnetic clutch for transmitting a rotational power from the pulley 20d to a shaft 22 is fixed to a distal end of the shaft 22 that rotatably extends through the pulley support axle 20a and the front end plate 28. The clutch plate 21 is selectively engaged with or disengaged from the pulley 20d by a electromagnetic force of a magnetically exciting coil 20c. The inner proximal end of the shaft 22 is coupled to the second end plate 15a of the movable scroll member 15. When the shaft 22 is rotated, the movable scroll member 15 is angularly revolved along a circular orbit of a predetermined radius around a center axis of the stationary scroll member 14 while being prevented from rotating around its own axis. In accordance with the angular motion, the working chambers 30 and 31 between the stationary and the movable scroll members 14 and 15 are progressively moved circumferentially and centripetally toward the centers of the scroll members while reducing their volumes, thus performing the processes, such as suction, compression and discharge of the refrigerant.

Figure 6A:
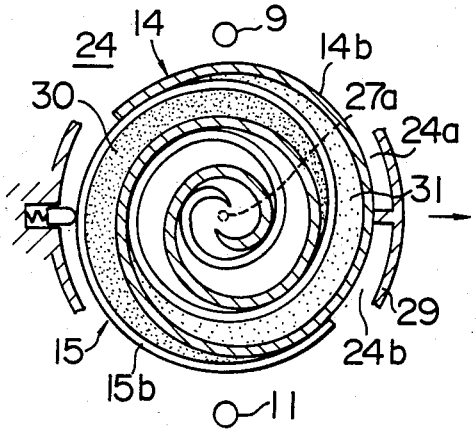
FIGS. 6A to 6D are views showing changes in angular position and volume of the working chambers in accordance with revolution of a movable scroll member.
Figure 6B:
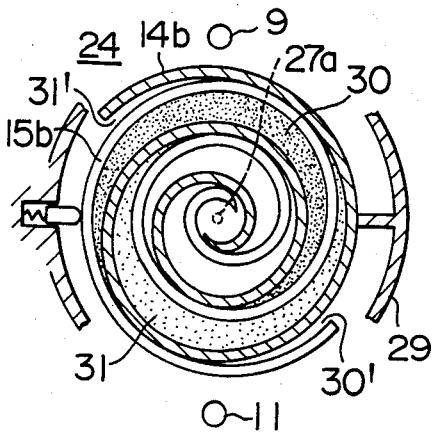
Figure 6D:
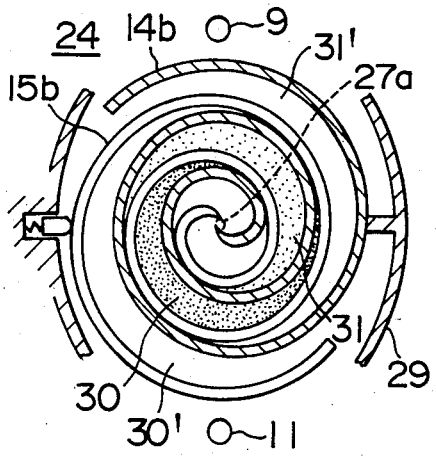
Figure 6C:
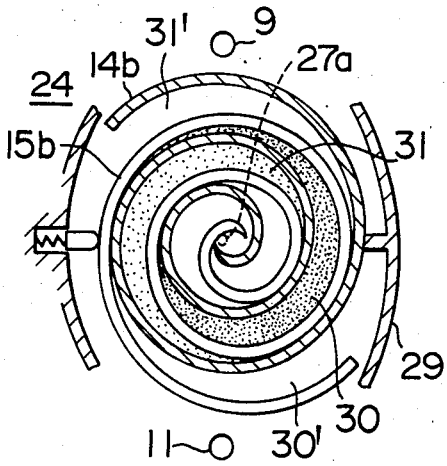

The processes in respect of the refrigerant sucked through the first suction port 9 will be explained hereinunder with reference to FIGS. 6A to 6D. In a position (FIG. 6A) where the revolving angle $\theta$ of the movable scroll member 15 around the center axis of the stationary scroll member 14 is held at zero, an inner surface of an outer end portion of the scroll element 14b of the stationary scroll member 14 is held in contact with an outer peripheral surface of the scroll element 15b of the scroll member 15, and at the same time, an inner surface of an outer end portion of the scroll element 15b of the movable scroll member 15 is held in contact with an outer peripheral surface of the scroll element 14b of the stationary scroll member 14. From that position, the movable scroll member 15 is revolved clockwise, so that the outer peripheral surfaces of the scroll elements 14b and 15b are separated from the inner surfaces of the outer end portions of the scroll elements 15b and 14b, respectively. As a result, as shown in FIG. 6B, spaces 30' and 31' are defined between the scroll elements 14b and 15b, which are opened to the suction chamber sections 24b and 24a, respectively. These spaces 30' and 31' are enlarged in volume as shown in FIGS. 6C and 6D, as the movable scroll member 15 is revolved, so that the refrigerant entering into the first suction chamber section 24a through the first suction port 9 is sucked therefrom to the space 31'. When the angular position becomes approximatly 360 degrees as shown in FIG. 6A, the outer peripheral surfaces of the scroll elements 14b and 15b come into contact with the inner surfaces of the outer end portions of the scroll elements 15b and 14b, respectively, so that the communication between the space 31' and the first suction chamber section 24a is interrupted, whereupon the suction cycle or process of the refrigerant is completed. Thereafter, the space 31' becomes the closed compressive working chamber 31. The angular motion of the movable scroll member 15 is further continued, and the compressive working chamber 31 is moved circumferentially and centripetally in a clockwise direction. In accordance with this motion, the volume of the working chamber 31 is gradually reduced, thus performing the compression of the refrigerant.

Similarly, with respect to the refrigerant sucked through the second suction port 11, the like processes are conducted. More specifically, the refrigerant is sucked first into the space 30', and at the angular position of approximately 360 degrees, the communication between the space 30' and the second suction chamber section 24b is interrupted. At this time, the suction process of the coolant is also completed. Thereafter, the space 30, becomes the closed compressive working chamber 30. In accordance with the continuous angular motion of the movable scroll 15, the compressive working chamber 30 is moved centripetally and circumferentially in the clockwise direction. Simultaneously, the volume of the working chamber 30 is also gradually decreased, thus performing the compression of the refrigerant. Then, at the final stage of the compression cycle, the compressive working chambers 30 and 31 are communicated with each other and at the same time are also communicated with the outlet port 27a.

Figure 5:
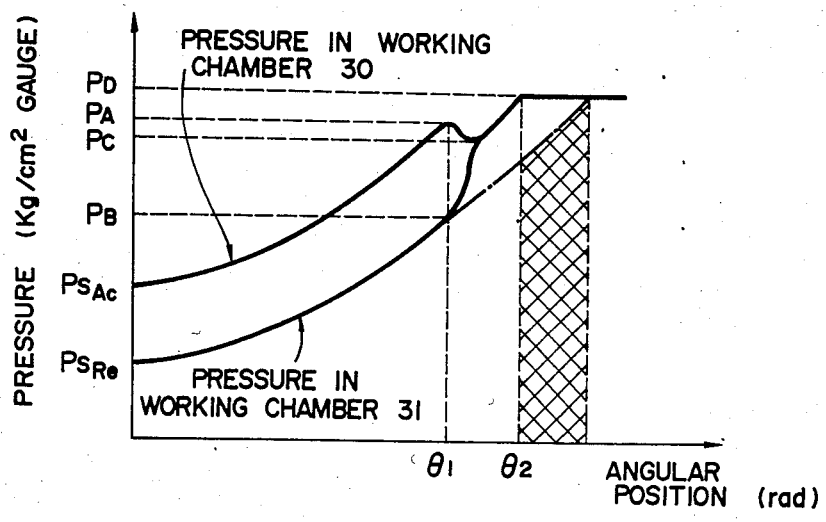
FIG. 5 is a diagram showing changes of pressure in working chambers.

FIG. 5 shows the pressure changes within the adjacent compressive working chambers 30 and 31 during the above-described cycle. At the starting point of the compression cycle of the two working chambers 30 and 31, the pressure of the working chamber 31 is equal to the suction pressure $Ps_{Re}$ of the refrigerant in the compressor 1 and is substantially the same as the evaporation pressure of the refrigerant (0.5 Kg/cm$^2$ gauge pressure). Also, since the refrigerant for air-conditioning is introduced into the working chamber 30, the pressure in the working chamber 30 is equal to the suction pressure $Ps_{Re}$ in the compressor 1 (this is substantially the same as the evaporation pressure of the refrigerant, i.e., 2.5 kg/cm$^2$ gauge pressure). Subsequently, accordance with the angular motion of the movable scroll member 15, the pressures of the two working chambers 30 and 31 are increased. When the movable scroll member 15 is revolved to $\theta_1$ (rad), the pressures in the working chambers 30 and 31 are raised to $P_A$ and $P_B$, respectively, and the working chambers are communicated with each other. Thus, the pressures in the two working chambers 30 and 31 become a certain equilibrium pressure $P_c$ ($P_A > P_c > P_B$). Also thereafter, the fluids are further compressed by the angular motion of the movable scroll member 15. However, it should be noted that a discharge valve 40 set at the outlet pressure $P_D$ ($> P_c$) is provided at the outlet port 27*a*. Accordingly, when the pressures in the working chambers 30 and 31 become higher than the pressure $P_D$, the discharge valve is opened so that the refrigerant is discharged to the high pressure pipe 3 through the outlet chamber 27 and the outlet port 2. Thus, the pressures of the refrigerant in the working chambers 30 and 31 are prevented from being raised above the pressure $P_D$, and also the refrigerant is discharged to the pipe 3 at the constant pressure $P_D$.

The structure and the operation of the scroll type compressor 1 is apparent from the foregoing description. The flow of the refrigerant discharged from the compressor 1 will hereinafter be described in more detail.

The gaseous refrigerant discharged from the compressor 1 is discharged through the high pressure pipe 3 to the condenser 4 where the gaseous refrigerant is condensed and thereafter, fed to the receiver 5. The liquid refrigerant from the receiver 5 is supplied to the refrigerant circuit Ac and the refrigerant circuit Re. In case that the electromagnetic valve 16 is "closed" and the electromagnetic valves 18 and 19 are both "opened", the liquid refrigerant from the receiver 5 is introduced into both the circuits Ac and Re through the electromagnetic valves 18 and 19.

The liquid refrigerant introduced into the refrigerant circuit Re is expanded by the expansion valve 12 and is introduced into the refrigerating evaporator 6 where the refrigerant is evaporated at the set pressure of, for example, 0.5 kg/cm$^2$ gauge pressure to absorb the ambient heat. The evaporated refrigerant passes through the check valve 17 and the low pressure pie 8 and flows into the first suction port 9 of the compressor 1. The liquid refrigerant introduced into the refrigerant circuit Ac is expanded by the expansion valve 13 and is introduced into the cooling evaporator 7 where the refrigerant is evaporated at, for example, 2.5 kg/cm$^2$ gauge pressure to absorb the ambient heat. The evaporated refrigerant passes through the low pressure pipe 10 and flows into the second suction port 11 of the compressor 1. The gaseous refrigerant thus returned back to the first and the second suction ports 9 and 11 is compressed in the above-described manner within the compressor 1, and thereafter is discharged again from the discharge port 2 thereof.

When the refrigeration is not needed, the refrigerant is made to flow through the refrigerant circuit Ac solely by closing the electromagnetic valve 18 and opening the electromagnetic valve 16. In this case, the refrigerant flows from the low pressure pipes 8 and 10 through the first and the second suction ports 9 and 11 into the compressor 1. It is to be noted that the check valve 17 serves to prevent the refrigerant for air-conditioning from flowing back to the refrigerating evaporator 6 through the low pressure pipe 8.

When the air-condition is not needed, the refrigerant is made to flow through the refrigerant circuit Re solely and is sucked through the first and second ports 9 and 11 into the compressor 1 by closing the electromagnetic valve 19 and opening the electromagnetic valves 16 and 18.

In the foregoing embodiment, the stationary partition 32 and the movable partition 33 are arranged in diametrically opposing each other (i.e., in 180° angularly offset) and the volumes of the first and the second suction chamber sections 24*a* and 24*b* are substantially the same. In other words, the suction chamber 24 is divided substantially into two halves by the partitions 32 and 33. However, in the case where the scroll compressor of this type is used for a refrigerating/cooling system of a refrigerator vehicle, it is particularly preferable that the volume of the first suction chamber section 24*a* becomes larger than that of the second suction chamber section 24*b*. This is because that, in the refrigerating-/cooling system of the refrigerator vehicle, the refrigerant for refrigerating is much more needed than that for air-conditioning. Accordingly, by making larger the volume of the first suction chamber section 24*a* into which the refrigerant for refrigerating is sucked than that of the second suction chamber section 24*b* into which the refrigerant for air-conditioning is sucked, it is possible to enhance the refrigerating performance in comparison with the cooling performance. Inversely, if the positions of the partitions 32 and 33 are selected so that the volume of the second suction chamber section 24*b* is larger than that of the first suction chamber section 24*a*, it is possible to enhance the cooling performance in comparison with the refrigerating performance. Therefore, this is effective for the ordinary automotive cooling/refrigerating system in which the refrigerant flow rate of the second suction chamber section having a high suction pressure must be heightened.

Figure 9:
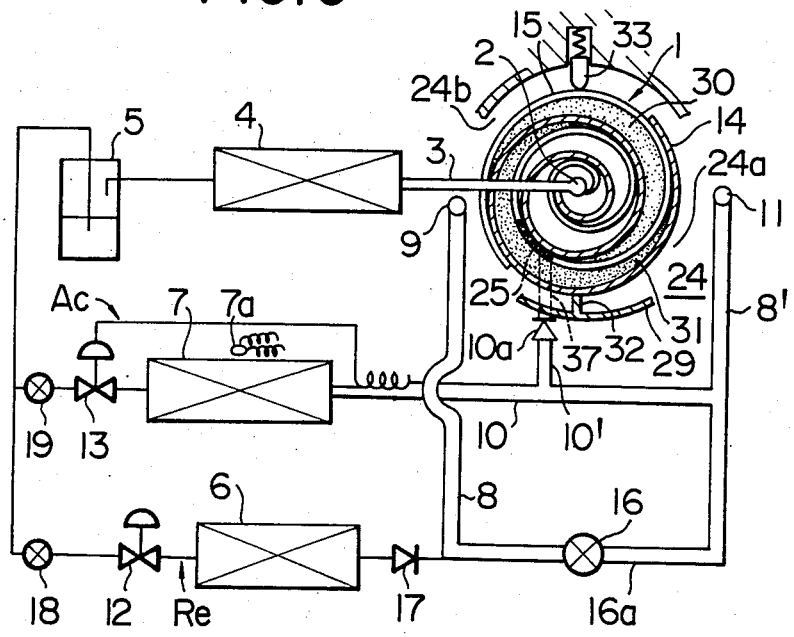
FIG. 9 is a view showing a piping system of a cooling/refrigerating system to which the compressor shown in FIG. 7 is applied.

FIG. 9 shows an automotive cooling/refrigerating system in which used is a scroll type compressor 1 in accordance with another embodiment of the invention. In this embodiment, the like members or components having the same functions as those in the first embodiment are designated by the same reference numerals or characters. In FIG. 9, the refrigerant circuit Re for refrigerating has a refrigerating evaporator 6. Disposed on an upstream side thereof is an expansion device composed of a constant pressure expansion valve 12 having a predetermined valve opening pressure of, for example, 0.5 kg/cm$^2$. On a downstream side thereof, a check valve 17 is provided. The downstream side of the check valve 17 is connected to a first suction port 9 of the compressor 1 through a low pressure pipe 8.

A refrigerant circuit Ac for air-conditioning has a cooling evaporator 7 on an upstream side of which disposed is an expansion device composed of a temperature sensing type expansion valve for regulating a refrigerant flow rate so as to control a super heating degree thereof at the evaporator outlet to a predetermined level. An outlet of the cooling evaporator 7 is connected through low pressure pipes 10 and 8; to a second suction port 11 of the compressor 1. The low pressure pies 8 and 8; are connected to each other through a connecting pipe 16*a* having an electromagnetic valve 16 in its mid-portion. The electromagnetic valve 16 is normally closed, and the refrigerating refrigerant and the air-conditioning refrigerant are sucked through the first and the second suction ports 9 and 11 into the compressor 1, respectively.

Figure 7:
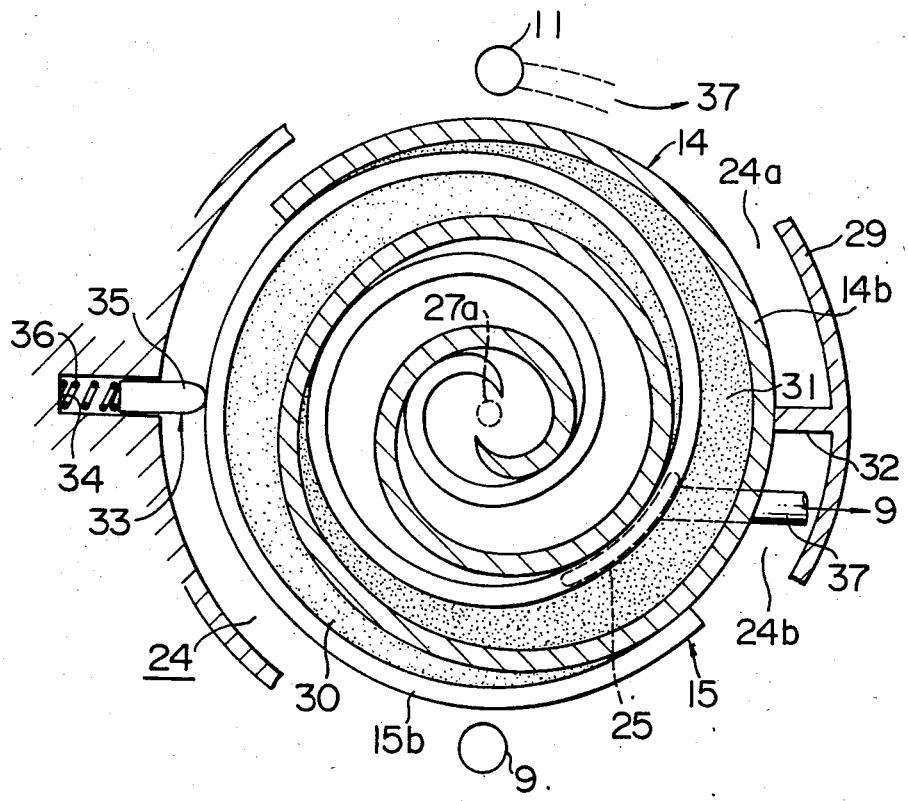
FIG. 7 is a fragmentary cross-sectional view taken along the line VII—VII of FIG. 8.
Figure 8:
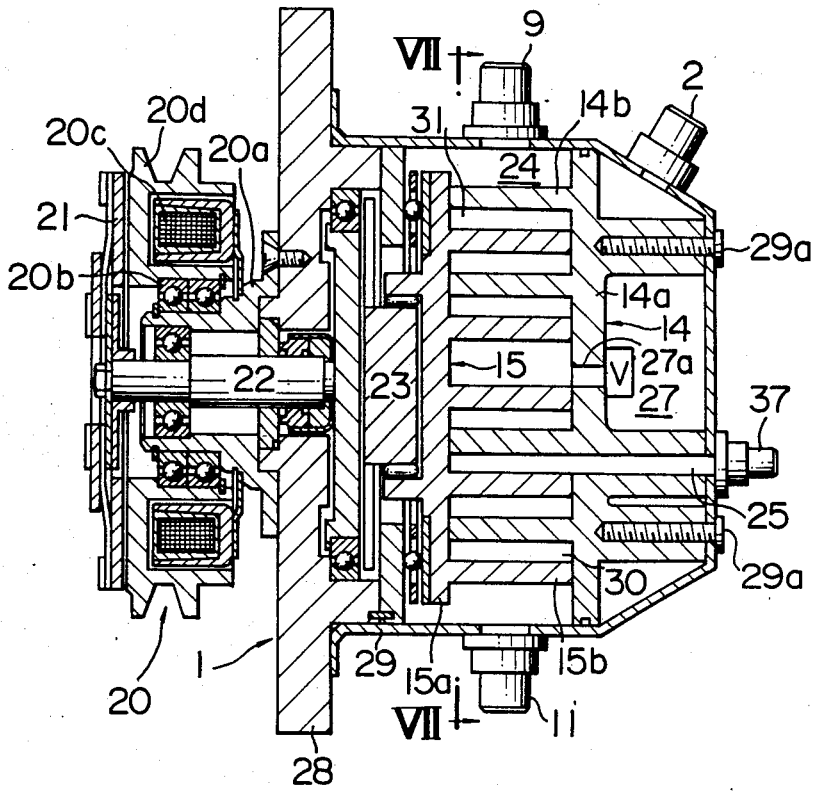
FIG. 8 is a longitudinal cross-sectional view showing the compressor shown in FIG. 7.
Figure 11A:
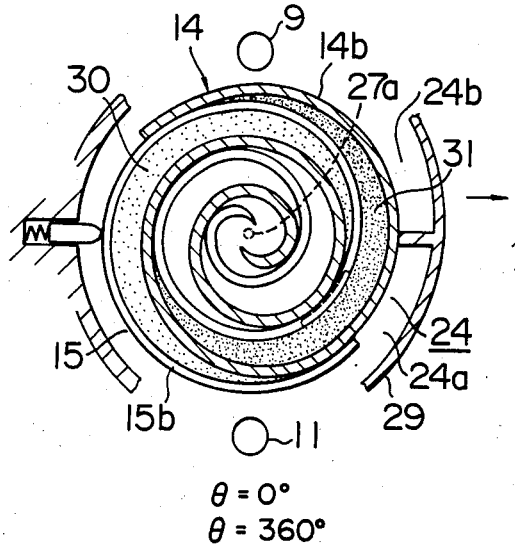
FIGS. 11A to 11D are views showing changes in angular position and volume of the working chambers shown in FIG. 7 in accordance with the revolution of the movable scroll member.
Figure 11B:
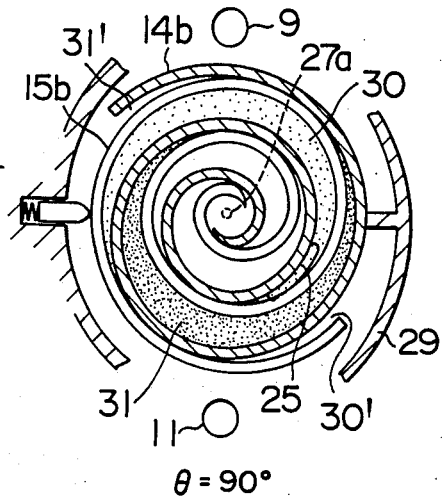
Figure 11D:
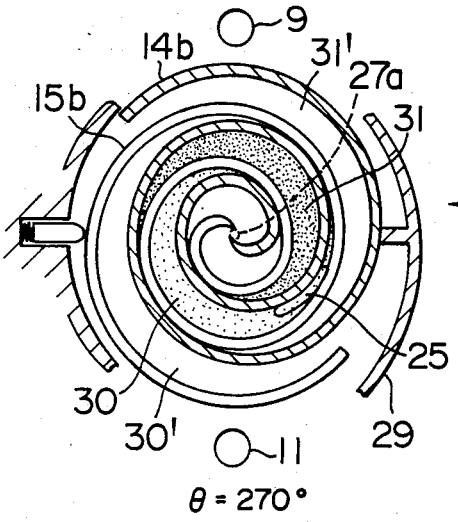
Figure 11C:
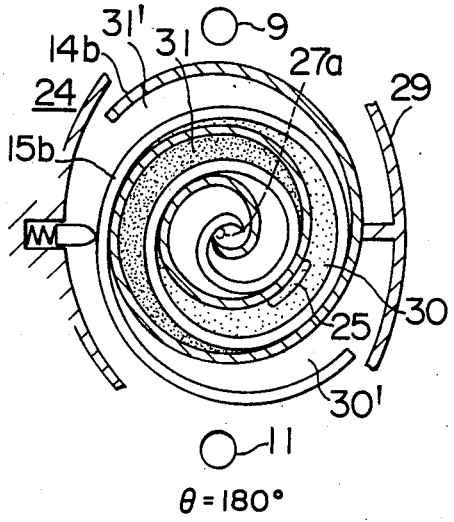

A sub-suction port 25 is formed in the end plate 14*a* of the stationary scroll member 14 and is always communicated with a sub-suction flow passage 37. The passage 37 is connected to the low pressure pipe 10 through a connecting pipe 10' having a check valve 10*a* in its mid-portion. The sub-suction port 25 is formed in an arcuate slit having a center of curvature substantially at a center axis of the stationary scroll member 14 as shown in FIG. 7. A width of the slit is somewhat smaller than a wall thickness (in a radial direction) of the scroll element 15*a* of the movable scroll member 15. The sub-suction port 25 is so disposed as to not only be closed by the scroll element 15b of the movable scroll member 15 as shown in FIG. 7 when the suction process of the refrigerating refrigerant to the compressive working chamber 30 is completed but be opened to the working chamber 30 as shown in FIG. 11B when the movable scroll member 15 is angularly moved somewhat from the position of FIG. 7, i.e. an initial stage of the compression process of the refrigerating refrigerant. At this time, since the pressure of the refrigerating refrigerant in the working chamber 30 is less than that of the cooling refrigerant (or about 2.5 kg/cm$^2$ gauge pressure), the cooling refrigerant reaching the sub-suction port 25 from the refrigerant circuit Ac for cooling through the sub-suction flow passage 37 is introduced into the working chamber 30 through the sub-suction port 25 by a pressure difference between the refrigerating refrigerant in the working chamber 30 and the cooling refrigerant.

Figure 10:
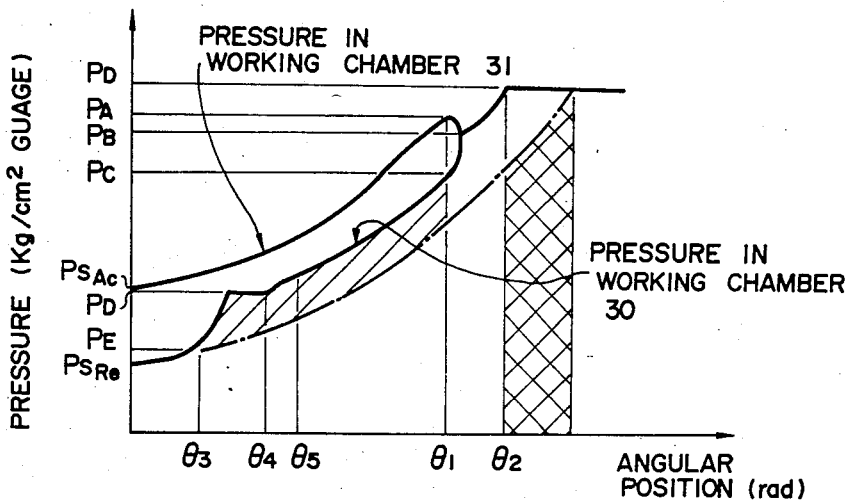
FIG. 10 is a diagram showing changes of pressure in the working chambers.

The changes in pressure of the two adjacent working chambers 30 and 31 of the scroll compressor 1 in accordance with this embodiment are shown in FIG. 10. The pressure in the working chamber 30 at a starting point of the compression process is equal to the suction pressure $Ps_{Re}$ of the refrigerating refrigerant to the compressor 1 and is substantially equal to an evaporation pressure (or 0.5 kg/cm$^2$ gauge pressure) of the refrigerating refrigerant. The pressure in the working chamber 31 is equal to the suction pressure $Ps_{Ac}$ of the cooling refrigerant in the compressor 1 (that is substantially equal to the evaporation pressure of 2.5 kg/cm$^2$ gauge pressure).

At an angular position $\theta_3$ where the compression process is somewhat effected in each of the working chambers 30 and 31, that is, at an angular position where the pressure in the working chamber 30 is raised to a pressure $P_E$ ($>Ps_{Re}$), the subsuction port 25 is opened to the working chamber 30. Therefore, a refrigerant having a third pressure (that refrigerant is the same as the refrigerant sucked into the working chamber 31 and hence has the same pressure) is introduced into the working chamber 30. As a result, the pressure in the working chamber 30 is raised to $P_D$. Subsequently, the check valve 10a is closed (at an angular position $\theta_4$) and the compression is again commenced Prior to the reclosing of the sub-suction port 25 (at an angular position $\theta_5$).

At a final stage of the compression process (at an angular position $\theta_1$), the pressures in the working chamber 30 and 31 reach pressures $P_c$ and $P_A$, respectively. At this time, the working chambers 30 and 31 communicate with each other, and the refrigerating refrigerant and the cooling refrigerant are mixed with each other. The pressures in the working chambers 30 and 31 are equilibated to each other at a pressure $P_B$ ($P_A>P_B>P_C$), and the refrigerant is further compressed in accordance with the angular motion of the movable scroll member 15. However, since a discharge valve 40 that is set at a discharge pressure $P_D$ ($>P_B$) is provided at the discharge port 27a, when the pressures in the working chambers 30 and 31 becomes higher than the pressure $P_D$, the discharge valve is opened to supply the refrigerant through the discharge chamber 27 and the outlet port 2 to the high pressure pipe 3 (at an angular position $\theta_2$). Thus, the refrigerant pressure within the working chambers 30 and 31 is prevented from being raised above the pressure $P_D$, and the refrigerant is supplied to the high pressure pipe 3 at the constant pressure $P_D$.

The other structure and operation of the scroll compressor and cooling/refrigerating system in accordance with the second embodiment are the same as those in the first embodiment, and hence further explanation therefor is omitted.

Figure 12:
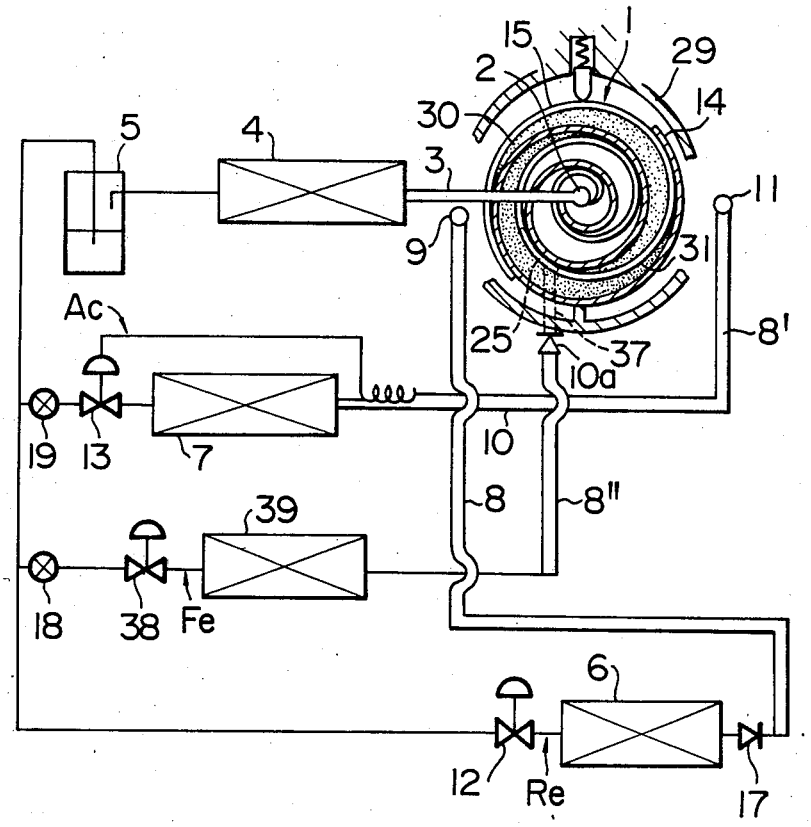
FIG. 12 is a view showing a piping system of a cooling/freezing/refrigerating system to which a compressor in accordance with still another embodiment is applied.

Also, the scroll type compressor in accordance with the present invention may be applied to a system having three refrigerant circuits each provided with an evaporator having a evaporation pressure which is different from other ones, as shown in FIG. 12. In a cooling/-freezing/refrigerating system in FIG. 12, there is provided a freezing circuit Fe in parallel to the refrigerating circuit Re, in addition to the cooling and the refrigerating circuits Ac and Re shown in FIG. 9. In FIG. 12, like components or members shown in FIG. 9 are designated by the same reference characters. The freezing circuit Fe is composed of an expansion valve 38 for setting an evaporation pressure $Ps_{Fe}$ of the freezing refrigerant and a freezing evaporator 39. The freezing evaporator 39 is connected at a downstream side thereof to the sub-suction flow passage 37 through a low pressure pipe 8'' and the check valve 10a. In this case, the relationship among the respective evaporation pressure is as follows:

$$Ps_{Ac}>Ps_{Fe}>PS_{Re}.$$

At initial stages of the compression processes of the cooling refrigerant and the refrigerating refrigerant, since the pressure $Ps_{Re}$ of the refrigerating refrigerant sucked into the compressive working chamber 30 is lower than the pressure $Ps_{Fe}$ of the freezing refrigerant which may be called third pressure, the freezing refrigerant is caused to flow through the sub-suction port into the working chamber 30 by the pressure difference, thus increasing the pressure of the refrigerating refrigerant within the working chamber.

As apparent from the foregoing description, if the refrigerant having a pressure higher than that of the refrigerant sucked into the working chamber 30 may be sucked into the working chamber 30 through the sub-suction port 25 at the initial stage of the compression process, the refrigerant may be compressed with high efficiency. Accordingly, the same effect may be obtained by the arrangement in which the low pressure pipe 8' is connected to the sub-suction flow passage 37 and the low pressure pipe 8'' is connected to the second suction port 9.

As is apparent from the foregoing description, the scroll type compressor in accordance with the present invention has an advantage that the fluids having two different pressure levels may be sucked and compressed, in addition to the inherent advantages of the scroll type compressor.

As is also apparent from FIG. 10, according to the present invention, at initial stages of the compression processes of the two working chambers to which the fluid having two different pressure levels are applied (at the angular position $\theta_3$ of the movable scroll member), a third fluid having a third pressure (this is higher than the pressure of one of the working chambers) is caused to flow into one of the working chambers (the working chamber 30 in the preferred embodiment) through the sub-suction port. Thus, the work corresponding to a hatched region in FIG. 10 may be saved in comparison with the case where the compression is performed without the introduction of the third fluid having the third pressure level (indicated by the dot-and-dash lines in FIG. 10). Also, according to the present invention, at a final stage of the compression processes (at the angular position $\theta_1$ of the movable scroll member), the adjacent two working chambers communicate with each other, and the low pressure Pc in one working chamber is raised to the equilibrium pressure $P_B$. Therefore, the work corresponding to the cross-hatched region in FIGS. 5 and 10 may be saved in comparison with the case where the refrigerant in each working chamber is compressed to the discharge pressure $P_D$ independently. The compression of the fluid may be effectively performed.

Also, if the stationary and movable partitions are selectively positioned, the flow amounts of the fluids in the first and second suction chamber sections may readily be changed.

What is claimed is:

1. A scroll compressor comprising:

a housing including therein a suction chamber;

a stationary scroll member fixedly disposed within said housing, said stationary scroll member including a first end plate and a first scroll element projecting from one surface of said first end plate;

a movable scroll member movably disposed within said housing, said movable scroll member including a second end plate and a second scroll element projecting from one surface of said second end plate opposite said one surface of said first end plate;

means for driving said movable scroll member to make it revolve around a center axis of said stationary scroll member but preventing said movable scroll member from revolving around its own axis;

a plurality of working chamber each defined by said first scroll element and said second scroll element which is angularly offset from and engaged with said first scroll element, a radially outermost working chamber opening to said suction chamber to introduce fluid to be pressurized from said suction chamber, and each of said working chambers moving centripetally and circumferentially, in order while decreasing a volume thereof upon revolution of said movable scroll member; outlet port means for discharging the pressurized fluid from said working chamber, said outlet port means including an outlet port;

a stationary partition extending from an inner wall surface of said housing to a radially outermost surface of said first scroll element of said stationary scroll member;

a movable partition radially reciprocatingly projecting from said inner surface of said housing and abutting against a radially outermost surface of said second scroll element of said movable scroll member;

two suction chamber sections into which said suction chamber is divided by both said scroll members and both said partitions;

first inlet port means having a first inlet port opening to one of said suction chamber sections for introducing thereinto fluid to be pressurized having a first pressure level;

second inlet port means having a second inlet port opening to the other suction chamber section for introducing thereinto fluid to be pressurized having a second pressure level different from said first pressure level; and sub-suction port means having a sub-suction port for introducing fluid to be pressurized having a third pressure level which is higher than said first pressure level, said sub-suction port means, at an initial stage of a compression process of the fluid having said first pressure level in one of said working chambers, being caused to communicate with said one working chamber into which is introduced the fluid having said third pressure level.

2. A scroll compressor according to claim 1, wherein said suction chamber sections are different from each other in volume.

3. A scroll compressor according to claim 1, wherein said first pressure level is lower than said second pressure level.

4. A scroll compressor according to claim 3, wherein said first inlet port communicates with a flow passage downstream side of a refrigerating evaporator of a refrigerating/cooling system which includes said scroll compressor, a condenser connected to downstream side of said compressor, and a cooling evaporator and said refrigerating evaporator which are disposed downstream side of said condenser and are arranged in parallel with each other, and wherein said second inlet port communicates with a flow passage downstream of said cooling evaporator.

5. A scroll compressor according to claim 1, wherein said first inlet port communicates with a flow passage downstream side of a refrigerating evaporator of a refrigerating/cooling system which includes said scroll compressor, a condenser connected to downstream side of said compressor, and a cooling evaporator and said refrigerating evaporator which are disposed downstream side of said condenser and are arranged in parallel with each other, and wherein said second inlet port and said sub-suction port communicate with a flow passage downstream of said cooling evaporator.

6. A scroll compressor according to claim 1, wherein said first, said second and said third pressure levels are different from one another, and wherein said first pressure level is lowest among them and said second pressure level is highest among them.

7. A scroll compressor according to claim 6, wherein said first inlet port communicates with a flow passage downstream side of a refrigerating evaporator of a refrigerating/cooling/freezing system which includes said scroll compressor, a condenser connected to downstream side of said compressor, and a cooling evaporator and a freezing evaporator which are disposed downstream side of said condenser and are arranged in parallel with each other, and said refrigerating evaporator disposed in parallel to said freezing evaporator, wherein said second inlet port communicates with a flow passage downstream of said cooling evaporator, and wherein said sub-suction port communicates with a flow passage downstream of said freezing evaporator.

8. A scroll compressor according to claim 1, wherein said outlet port means has a valve unit which opens at a predetermined pressure level, and wherein during a communication between said sub-suction port and said working chamber, a fluid having said first pressure level in the working chamber is pressurized up to a pressure level between said first pressure level and said third pressure level, and wherein said working chamber and a working chamber adjacent thereto are caused to communicate with each other to equilibrate the fluids therein into an equilibrium pressure level when said two working chambers are moved centripetally and circumferentially close to a center of said housing by the revolution of said movable scroll member, and the equilibrated fluids are further pressurized up to said predetermined level in accordance with revolution of said movable scroll member and discharged through said valve unit of said outlet port means.

* * * * *